US005772418A

United States Patent [19]

Tateno et al.

[11] Patent Number: 5,772,418

[45] Date of Patent: Jun. 30, 1998

[54] SCREW TYPE COMPRESSOR ROTOR, ROTOR CASTING CORE AND METHOD OF MANUFACTURING THE ROTOR

[75] Inventors: Masao Tateno; Koji Tomita, both of Tochigi-ken, Japan

[73] Assignee: Tochigi Fuji Sangyo Kabushiki Kaisha, Tochigi-ken, Japan

[21] Appl. No.: 626,017

[22] Filed: Apr. 1, 1996

[30] Foreign Application Priority Data

Apr. 7, 1995 [JP] Japan ..... 7-082484
Jul. 25, 1995 [JP] Japan ..... 7-189219

[51] Int. Cl.[6] ..... F01C 1/18
[52] U.S. Cl. ..... 418/206.5
[58] Field of Search ..... 418/206.5, 205

[56] References Cited

U.S. PATENT DOCUMENTS

| | | | |
|---|---|---|---|
| 2,714,314 | 8/1955 | Ulander | 74/434 |
| 2,857,779 | 10/1958 | Frei | 74/466 |
| 4,971,536 | 11/1990 | Takeda et al. | 418/206.5 |
| 5,180,299 | 1/1993 | Feuling | 418/206.5 |
| 5,320,508 | 6/1994 | Kiefer | 418/206.5 |

FOREIGN PATENT DOCUMENTS

| | | |
|---|---|---|
| 0 637 691 A1 | 2/1995 | European Pat. Off. . |
| 693 372 | 7/1940 | Germany . |
| 882 746 | 7/1949 | Germany . |
| 1 000 131 | 1/1957 | Germany . |
| 24 09 554 | 9/1975 | Germany . |
| 195 02 323 A1 | 8/1996 | Germany . |
| 7-16001 Y2 | 4/1995 | Japan . |
| 7-151082 A | 6/1995 | Japan . |

*Primary Examiner*—Charles G. Freay
*Attorney, Agent, or Firm*—Thomas, Kayden, Horstemeyer & Risley

[57] ABSTRACT

There are provided male and female rotors, which engage with each other at screw-shaped tooth trace portions formed on the rotor bodies; a compressor casing which houses these rotors and has a suction port on one side in the axial direction and a discharge port on the other side in the axial direction; hollow portions which are provided in the tooth trace portions of the male screw rotor and communicate with the suction port; and partition walls which are provided at the end on the discharge port side of the tooth trace portions and block the hollow portions.

7 Claims, 10 Drawing Sheets

SCREW TYPE COMPRESSOR ROTOR, ROTOR CASTING CORE AND METHOD OF MANUFACTURING THE ROTOR

BACKGROUND OF THE INVENTION

1. Field of the Invention

The present invention relates to a screw-type compressor used, for example, for a supercharger of vehicles.

2. Description of the Related Art

The publication of Japanese Utility Model Application Publication No. HEI 2-37286 describes "Rotor for screw-type supercharger or compressor."

The compressor is provided with male and female screw rotors, a compressor casing, and a suction port and a discharge port both of which are provided on the compressor casing, a gas sucked from the suction port being supplied under pressure in the axial direction and discharged from the discharge port.

The respective rotor consists of a steel rotor shaft and an aluminum alloy rotor body, and has a large moment of inertia.

Generally, a screw-type compressor is widely used for a super charger of vehicles. Since the screw-type compressor rotates at a high speed, a large moment of inertia causes a loss in drive energy to become large and a response at acceleration to become poor; and in order to prevent a slippage of an electromagnetic clutch for interrupting the connection between an engine and a supercharger, the electromagnetic clutch must be made large in size. Further, a large moment of inertia can cause rotors to contact with each other at a rapid acceleration or deceleration, and thus a coating on the surface to be peeled.

Although to make the moment of inertia small, it suffices to provide a hollow portion in the rotor, a pressure leakage occurs from the discharge side through the hollow portion to the suction side, thereby reducing efficiency. Although a provision of a partition wall at the central part of the hollow portion allows the pressure leakage to be prevented, a bag portion is formed on the discharge side to cause a high-pressure gas to accumulate in the bag portion and thus the gas to flow from the clearance between the rotors back to the suction side.

SUMMARY OF THE INVENTION

An object of the present invention is to provide a screw-type compressor which has screw rotors with a small moment of inertia, exhibits no pressure leakage, and has a high efficiency.

Another object of the present invention is to provide a rotor of the screw-type compressor which allows an inertia efficiency to become small by being lightened, requires no special filling material, and is simple in machining to attain a reduced cost. In addition, still another object of the present invention is to provide a rotor casting core and a method of manufacturing the rotor.

The screw-type compressor of the present invention is characterized in that the compressor is provided with male and female rotors which engage with each other at screw-shaped tooth trace portions formed on the rotor bodies; a compressor casing which houses these rotors and has a suction port on one side in the axial direction and a discharge port on the other side in the axial direction; hollow portions which are provided in the tooth trace portions of either or both of the screw rotors and communicate with the suction port; and partition walls which are provided at the end on the discharge port side of the tooth trace portions and block the hollow portions.

The rotor body may be casted to provide the hollow portion and the partition wall in the tooth trace portion.

The inner periphery of the hollow portion may be provided with ribs.

The inner periphery of the hollow portion may be provided with a balancer for keeping a rotational balance with the partition wall.

In this way, the hollow construction of the tooth trace portion causes the moment of inertia of the screw rotor to become significantly small, so that, for example, a vehicle mounted with the screw-type compressor of the present invention as a supercharger can improve largely a response at an acceleration and also make small in size an electromagnetic clutch for interrupting the connection between the engine and the supercharger. Further, the small moment of inertia allows the mutual contact of screw rotors at a rapid acceleration or deceleration to be prevented, and thus a coating on the rotor surface to be made thin or disused.

The hollow portion is blocked by the partition wall, so that no pressure leakage between the discharge and suction sides occurs. The partition wall is provided at the end on the discharge port side of the tooth trace portion (the hollow portion), so that a bag portion as with the prior art example of rotor is not formed on the discharge side, whereby no high-pressure gas flows through the clearance between the rotor's back to the suction side. Thus, a reduction in efficiency due to a pressure leakage and the like is prevented.

Further, the hollow portion communicates with the suction port, so that the screw rotor is cooled by a fresh gas entering the hollow portion from the suction side and thus a thermal expansion is relieved, whereby a clearance between screw rotors and a clearance between a screw rotor and the compressor casing are kept proper at all times and thus a desired performance is maintained.

The hollow portion forms a Helmholtz's resonance tube to cause a noise on the suction port side to be reduced by a resonance phenomenon, so that the rotational noise becomes quiet to that extent.

The rotor body having the tooth trace portions of a hollow construction whose one end is blocked by the partition wall can be easily manufactured by casting, thereby providing a high productivity and a reduced cost. The hollow construction causes the rotor body to become thin in thickness, the molten metal flow at casting to be improved and remaining air bubbles to be reduced, and the rotational balance to be improved, so that balance keeping becomes easy or unnecessary.

Where the inner periphery of the hollow portion is provided with ribs in the tooth trace direction and rotational direction, the rigidity of the tooth trace portion is improved by the reinforcing effect of the ribs to cause the screw rotor to withstand a larger load and the deformation of the tooth trace portion to become less at a rapid acceleration/deceleration, whereby a mutual contact between screw rotors is prevented.

The ribs serve as cooling fins to cause the cooling effect of the screw rotors to be improved by a gas entering the hollow portion from the suction side and thus a thermal expansion is relieved, whereby a variation in both a clearance between screw rotors and a clearance between a screw rotor and the compressor casing is reduced and thus the performance becomes stable.

Where ribs in the tooth trace direction are provided, the rotor body is easily taken out of a mold, thereby providing an easy casting and a high productivity.

Where the inner periphery of the hollow portion is provided with a balancer keeping a rotational balance with the partition wall, the screw rotor thus improved in rotational balance withstands a higher rotation, thereby allowing the capacity and discharge pressure of the screw-type compressor to be increased.

A method of manufacturing a rotor for compressors of the present invention includes steps of supporting an end of a disappearance-type core for forming hollow portions corresponding to the number of rotor tooth trace portions by a supporting member through a side bar penetrating a part of a portion becoming a partition wall after rotor forming, and positioning the core; setting the core in an outer mold for the rotor; casting a molten metal into the mold and cooling the metal to solidify; removing the outer mold and the core; and blocking a hole of the side bar penetrating a part of the partition wall with a blocking member.

According to the method, a hollow rotor having a partition wall and an opening can be easily manufactured at a high productivity and a reduced cost. The rotor manufactured by this method has a high spacing accuracy in the axial and rotational directions and thus a good rotational balance. A contact between the rotors or between the rotor and the casing is prevented.

The present invention provides a rotor for screw-type compressors which has screw-shaped tooth trace portions on the outer periphery and a rotor shaft is fixedly pressure fitted into the center hole, characterized in that the rotor consists of a casted product, that a hollow portion extending in the axial direction is formed in the above-mentioned tooth trace portion by a disappearance-type core at the casting; and that the side bar hole of the above-mentioned disappearance-type core is provided on a plane on which the inner periphery of the above-mentioned center hole is fittingly engaged with the rotor shaft.

The above-mentioned core may be formed for each tooth trace portion of the rotor, and also formed in a segment section of the central angle corresponding to the number of the above-mentioned tooth trace portions in such a manner that the central portion in the diametrical direction at the point when a side bar forming the above-mentioned side bar hole is assembled exhibits a cylindrical shape when all cores are assembled.

In this construction, when the rotor is casted, a hollow portion is formed in the tooth trace portion by the disappearance-type core, so that the inertia efficiency of the rotor can be made small. The pressure fitting of the rotor shaft into the center hole of the rotor allows the side bar hole to be securely blocked. Therefore, the side bar hole is not provided on the end face of the rotor and thus it becomes unnecessary to take an extra measures for blocking the hole, thereby allowing an increase in machining cost to be prevented. No opening is provided on the end face of the rotor, thereby eliminating such a problem that a compressed air leaks to cause the compression efficiency to be reduced.

This core is constructed of a material which collapses in shape after being used and can be taken out to the outside, for example, sand or the one which disappears due to heat, and kept in a certain shape by bundling of the central portions of the side bars.

The present invention provides a method of manufacturing a hollow rotor which has a partition wall at least one end of the rotor and is casted by the use of disappearance-type cores corresponding to the number of tooth trace portions of the rotor, including steps of positioning a core on the partition wall side by forming a core assembly inward from the partition wall in the axial direction of the rotor rotational shaft; setting the core in an outer mold for the rotor; casting a molten metal into the mold and cooling the metal to solidify; and removing the outer mold and the core.

According to this method, the above-mentioned rotor can be easily manufactured.

BRIEF DESCRIPTION OF THE DRAWINGS

FIG. 2 is viewed from the arrow III side.

FIG. 2 is viewed from the arrow IV side.

FIGS. 15A–15E show a composition of a rotor as a comparison example of the present invention, in which FIG. 15A is an external side view; FIG. 15B, a view taken on line XVB—XVB in the arrow direction of FIG. 15A; FIG. 15C, a view taken on line XVC—XVC in the arrow direction of FIG. 15A; FIG. 15D, a view along the tooth trace portion; and FIG. 15E, a sectional view of a core used to manufacture the rotor.

DETAILED DESCRIPTION OF THE PREFERRED EMBODIMENT

Figure 1:
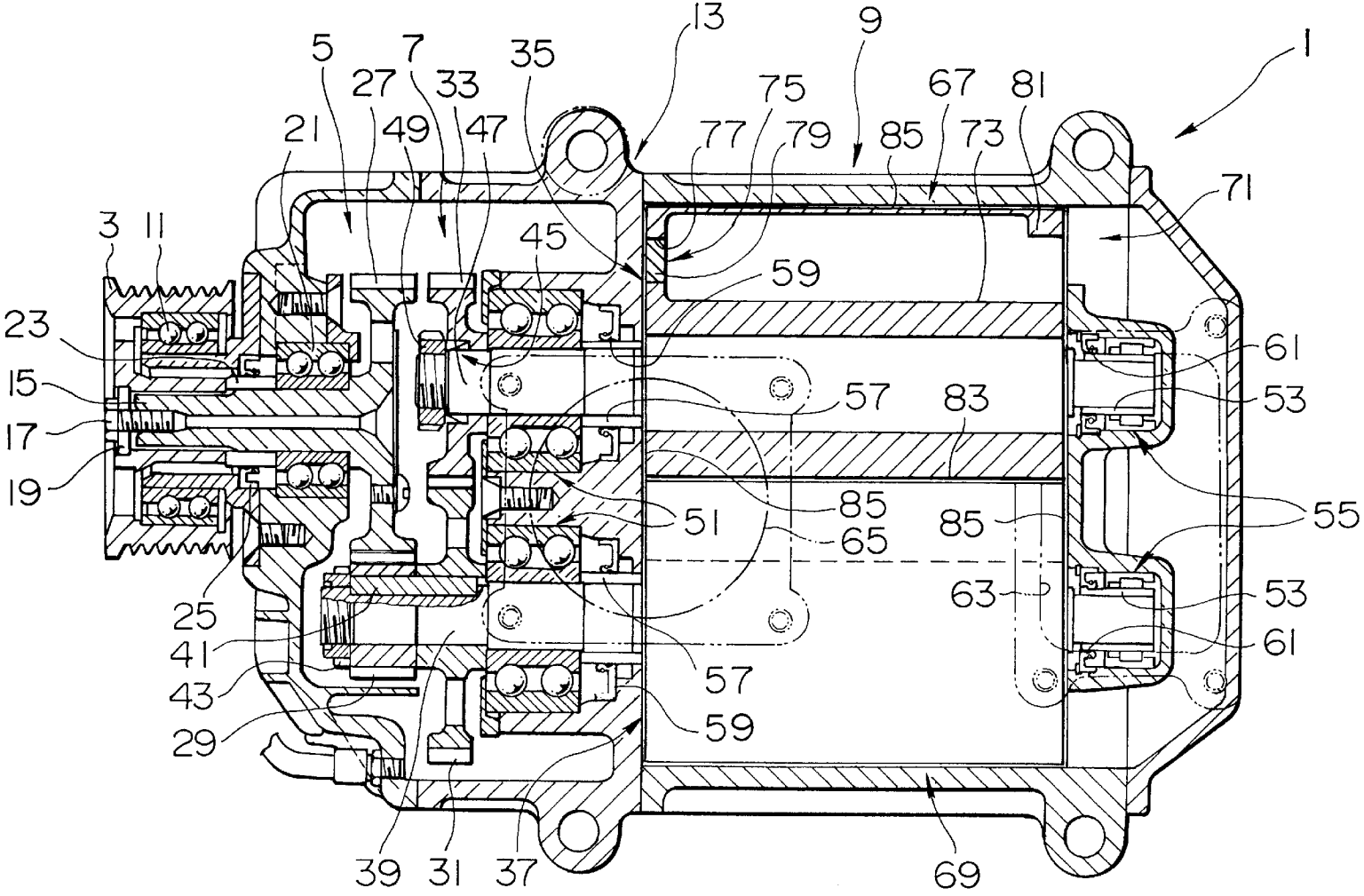
FIG. 1 is a sectional view of a first embodiment of the present invention, in which a male screw rotor 35 shows a section in the I—I tooth trace direction of FIG. 4.

With reference to FIGS. 1 through 4, a first embodiment of the present invention will be explained. FIG. 1 shows a supercharger 1 using this embodiment. The right/left directions are those in FIG. 1, and members not designated by reference codes are not illustrated.

As shown in FIG. 1, the supercharger 1 consists of an input pulley 3, a speed-increasing gear set 5, a timing gear set 7, a screw-type compressor 9 of this embodiment and the like.

The input pulley 3 is supported by a bearing 11 to a compressor casing 13, spline connected to an input shaft 15, and fixed with a bolt 17 and a washer 19. The input pulley 3 is connected through a belt to a pulley on a crank shaft side. Arranged on the pulley on the crank shaft side is an electromagnetic clutch, which interrupts the connection between an engine and the supercharger 1. When the electromagnetic clutch is connected, the input pulley 3 is rotatably driven by a drive force of the engine.

The input shaft 15 is supported by a bearing 21 to the inside of the casing 13, and arranged between a collar 23 mounted onto the input shaft 15 and the casing 13 is a seal 25 to prevent an oil leakage.

The speed-increasing gear set 5 consists of a large-diameter and a small-diameter speed-increasing gears 27, 29 engaging with each other, while the timing gear set 7 consists of a large-diameter and a small-diameter timing gears 31, 33 engaging with each other. The air compressor 9 is provided with a male and a female screw rotors 35, 37.

The large-diameter speed-increasing gears 27 are integrally formed at the right end of the input shaft 15, while the small-diameter speed-increasing gears 29 together with the large-diameter timing gears 31 are connected through a key 41 to a rotor shaft 39 of the female screw rotor 37 and prevented by a nut 43 from falling. The small-diameter timing gears 33 are connected through a taper lock mechanism 45 to a rotor shaft 47 of the male screw rotor 35.

The taper lock mechanism 45 is used to position the screw rotors 35, 37 in the rotational direction by engaging of the timing gear 33 with the timing gear 31 in a state in which the screw rotors 35, 37 are not contacted with each other, and then by tightening of a nut 49 to lock them.

The rotor shafts 47, 39 of the screw rotors 35, 37 are supported by ball bearings 51 at the left end and by collars 53 and roller bearings 55 mounted at the right end to the casing 13. Seals 59 are arranged between collars 57 mounted at the left end of the rotor shafts 47, 39 and the casing 13, while seals 61 are arranged between collars 53 at the right end and the casing 13, thereby preventing an air leakage.

The drive force of the engine inputted from the pulley 3 is increased in speed by the speed-increasing gear set 5, and rotatably drives through the timing gear set 7 the screw rotors 35, 37. The air compressor thus driven supplies under pressure the suction air sucked from a suction port 63 in the right/left axial directions between the screw rotors 35, 37, and discharges the air from a discharge port 65 to supply to the engine.

The screw rotors 35, 37 consist of the rotor shafts 47, 39 and rotor bodies 67, 69 fixed to the outer periphery.

Figure 2:
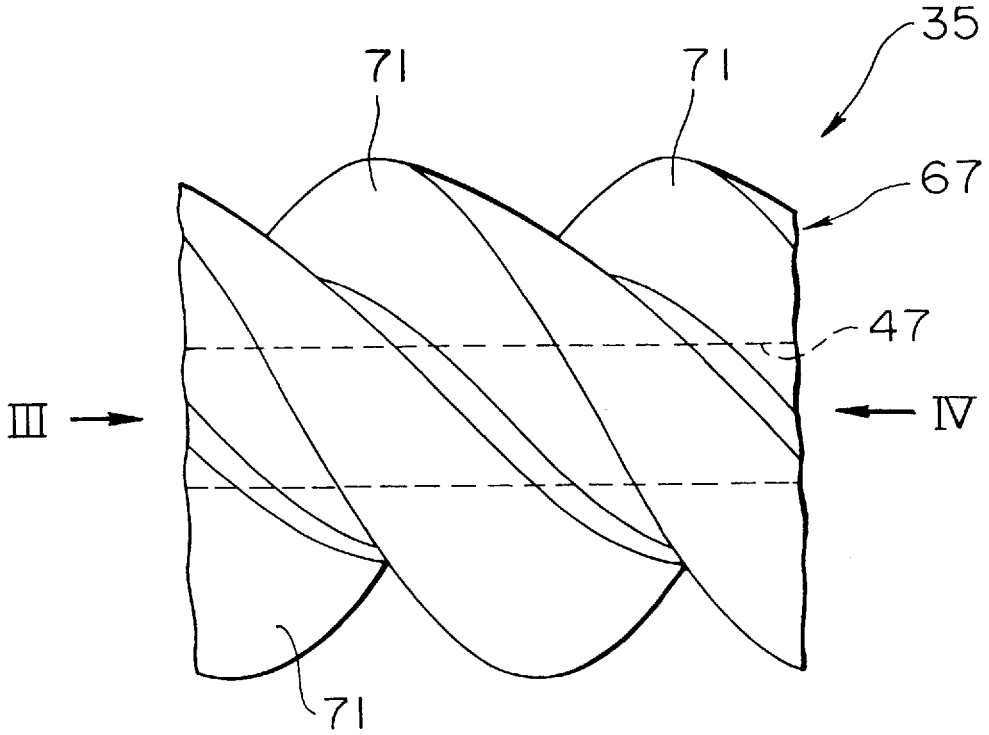
FIG. 2 is a front view of the male screw rotor 35.
Figure 3:
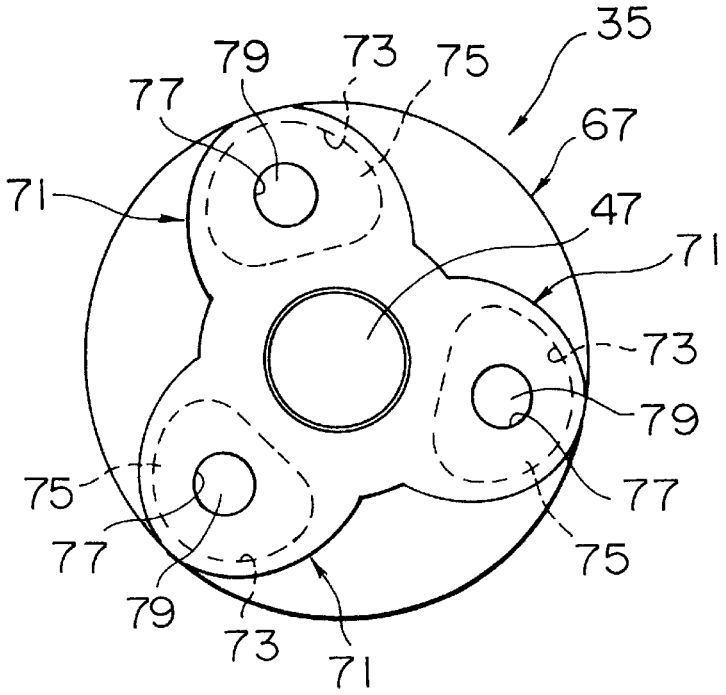
FIG. 3 is a view when
Figure 4:
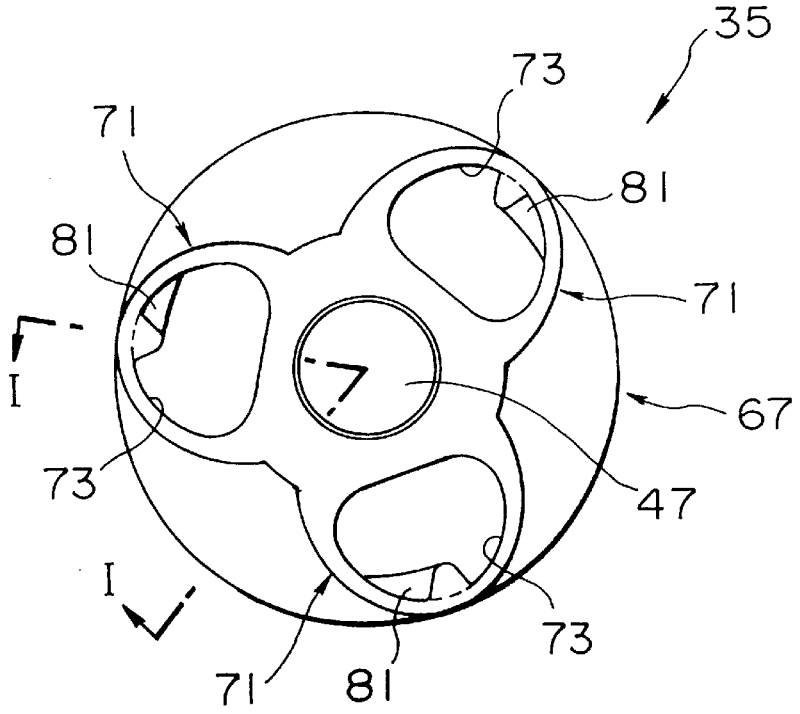
FIG. 4 is a view when

As shown in FIGS. 2, 3, 4, the rotor body 67 of the male screw rotor 35 is provided with three screw-shaped tooth trace portions 71. The rotor body 67 is casted and machined, in which formed in the tooth trace portion 71 is a hollow portion 73 communicating with the suction port 63, and provided at the end on the discharge port 65 side of the tooth trace portion 71 is a partition wall 75 for blocking the hollow portion 73. The partition wall 75 is provided with an opening 77 to facilitate the casting into a mold and the gas releasing at casting. After casting, the opening 77 is blocked by being fittingly engaged and welded with a pin 79. The pin 79 is metallic and has the same thermal expansion coefficient as that of the rotor body 67. The pin 79 is fittingly engaged and welded with the opening 77 so as not to generate a looseness due to a change in the pressure within the hollow portion 73.

Provided at the end on the suction port 63 side on the inner periphery of the hollow portion 73 is a balancer 81 for keeping a rotational balance of the rotor body 67 against a mass of the partition wall 75.

In this way, the supercharger 1 is composed.

As described above, the moment of inertia of the screw-type compressor 9 becomes significantly small by employing of the hollow construction for the tooth trace portion 71 of the male screw rotor 35 with a thick tooth thickness, so that a vehicle mounted with the supercharger 1 is largely improved in the response at acceleration, and no slippage associated with the interruption with the engine occurs, thereby making small in size the electromagnetic clutch between the engine and the supercharger 1. The moment of inertia is small, so that even at a rapid acceleration or deceleration, a contact between the screw rotors 35, 37 is prevented, thereby allowing a coating on the rotor surface to be made thin or disused.

The hollow portion 73 is blocked by the partition wall 75, so that no pressure leakage on the discharge and suction sides occurs. The partition wall 75 is provided at the end on the discharge port 65 side of the tooth trace portion 71, so that unlike the prior art, no bag portion is formed on the discharge side of the rotor, whereby no high-pressure gas flows through the clearance between the screw rotors 35, 37 back to the suction side. Thus, a reduction in efficiency due to a pressure leakage and the like is prevented.

The hollow portion 73 communicates with the suction port 63, so that the screw rotor 35 is cooled by a fresh air entering the hollow portion 73 from the suction side and thus a thermal expansion is relieved. Therefore, a clearance 83 between screw rotors 35, 37 and a clearance 85 between the screw rotor 35 and the compressor casing 13 are kept proper at all times and thus a desired performance is maintained.

The hollow portion 73 forms a Helmholtz's resonance tube to cause a noise on the suction port 63 side to be reduced by a resonance phenomenon, so that the supercharger 1 becomes quiet to that extent.

The balancer 81 is provided on the inner periphery of the hollow portion 73, and the partition wall 75 is provided to the tooth trace portion 71 so as to offset a rotational unbalance of the rotor body 67 and improve the rotational balance, so that the screw rotor 35 thus improved in the rotational balance withstands a higher rotation, thereby allowing the load of the supercharger 1 to be increased, and thus the capacity and discharge pressure of the compressor to be increased.

Then, with reference to FIGS. 5 and 6, a second embodiment of the present invention will be explained. In the description of this embodiment, members having the same function as that of those of the above-mentioned first embodiment are designated by the same reference codes, and thus the description of the members having the same function will be omitted. The right/left directions are those in FIG. 6.

Figure 5:
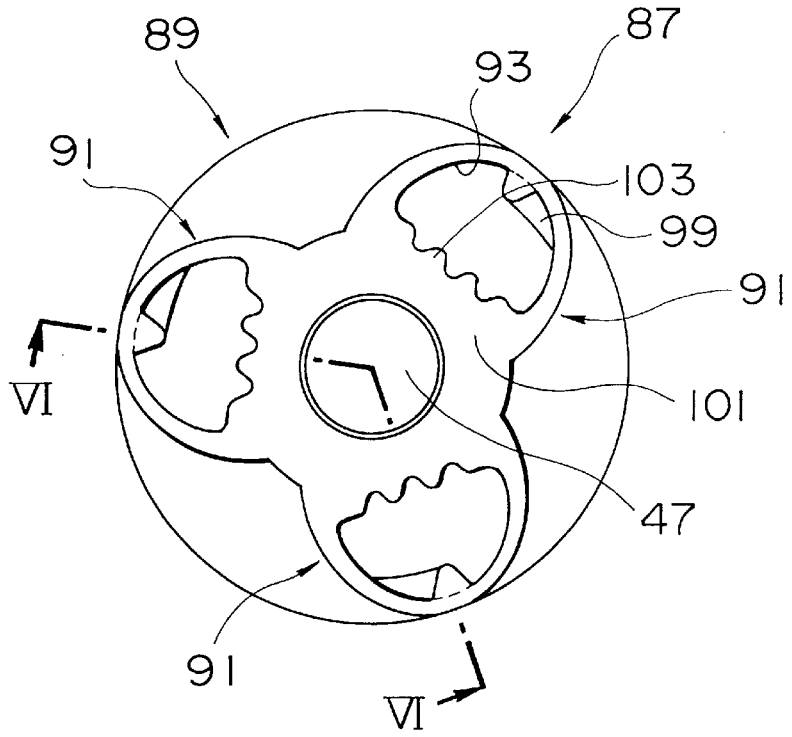
FIG. 5 is a side view when a male screw rotor 87 used in a second embodiment of the present invention is viewed from the opening of a hollow portion 93.
Figure 6:
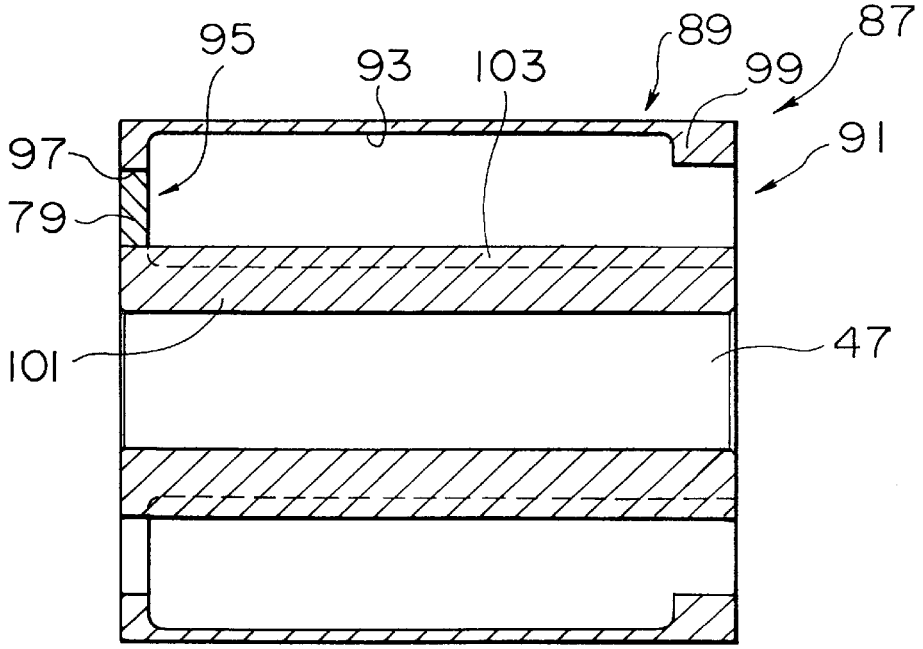
FIG. 6 is a sectional view in the VI—VI tooth trace direction of FIG. 5.

FIGS. 5 and 6 show a male screw rotor 87 used for the screw-type compressor. The male screw rotor 87 engages through the timing gear set 7 with the female screw rotor 37 without contacting therewith.

The screw rotor 87 consists of the rotor shaft 47 and a rotor body 89 fixed onto the outer periphery.

As shown in FIGS. 5 and 6, the rotor body 89 of the screw rotor 87 is provided with three screw-shaped tooth trace portions 91. The rotor body 89 is casted and machined. Formed in the tooth trace portion 91 is a hollow portion 93 communicating with the suction port 63, and provided at the end on the discharge port 65 side of the tooth trace portion 91 is a partition wall 95 for blocking the hollow portion 93. As with the above-mentioned screw rotor 35, the partition wall 95 is provided with an opening 97 to facilitate the casting into a mold and the gas releasing at casting, and after casting, the opening 97 is blocked by being threadbare attached with the pin 79.

Provided at the end on the suction port 63 side on the inner periphery of the hollow portion 93 is a balancer 99 for keeping a rotational balance of the rotor body 89 against a mass of the partition wall 95.

Formed on the base portion 101 of the rotor body 89 are four ribs 103 in the tooth trace direction.

In this way, this embodiment has the same effect as the first embodiment by employing of the hollow construction for the tooth trace portion 91 with a thick tooth thickness.

In addition, the reinforcing effect of the ribs 103 causes the rigidity of the tooth trace portion 91 to be improved, thus the screw rotor 87 to withstand a larger load, and a deformation of the tooth trace portion 91 to become less even at a rapid acceleration/deceleration, thereby preventing a contact between the screw rotors 87, 37. The ribs 103 serve as cooling fins to cause the cooling effect of the screw rotor 87 to be improved by a fresh air and thus a thermal expansion is relieved, whereby a variation in both a clearance between screw rotors 87, 37 and a clearance between the screw rotor 87 and the compressor casing 13 is reduced.

Further, the ribs 103 in the tooth trace direction are easily taken out of a mold, whereby the rotor body 89 is easily casted and has a high productivity.

Then, with reference to FIGS. 7 and 8, a third embodiment of the present invention will be explained. The screw-type compressor of this embodiment includes features of claims 1, 2, 4, 5. In the description of this embodiment, members having the same function as that of those of the above-mentioned first and second embodiments are designated by the same reference codes, and thus the description of the members having the same function will be omitted. The right/left directions are those in FIG. 8.

Figure 7:
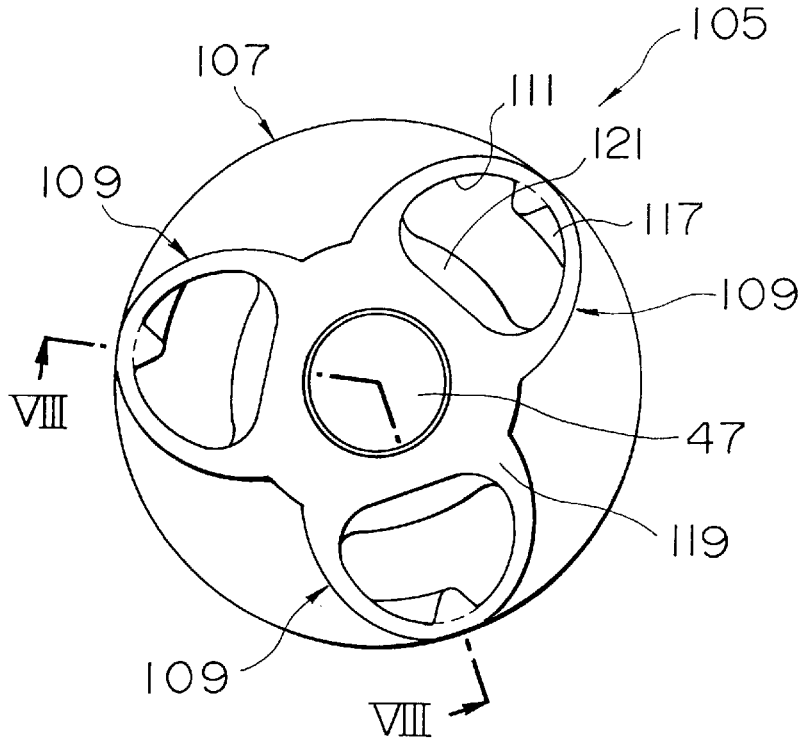
FIG. 7 is a side view when a male screw rotor 105 used in a third embodiment of the present invention is viewed from the opening of a hollow portion 111.
Figure 8:
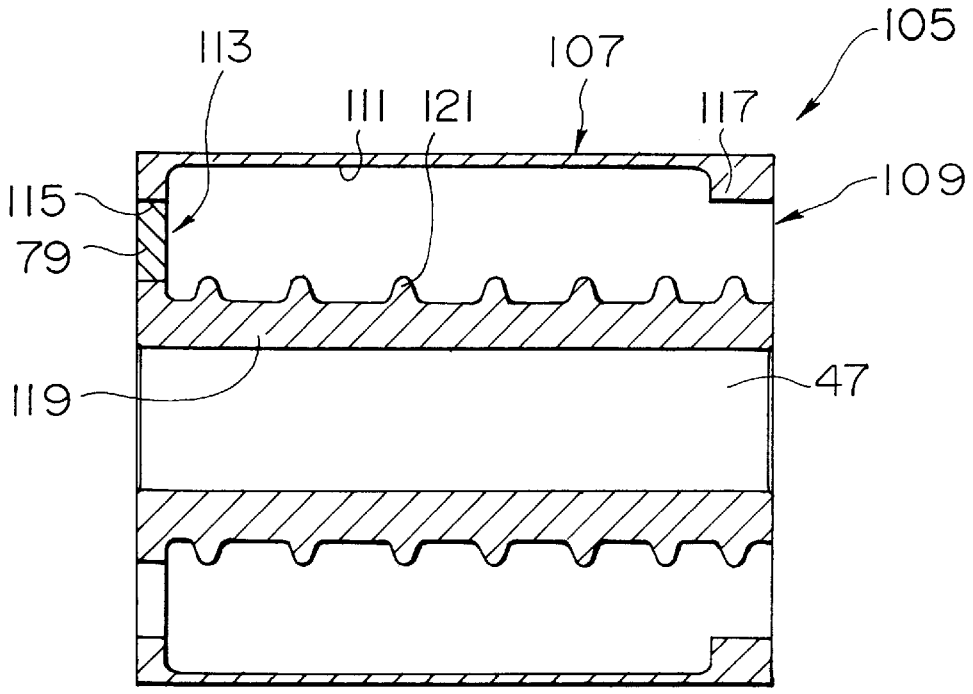
FIG. 8 is a sectional view in the VIII—VIII tooth trace direction of FIG. 7.

FIGS. 7 and 8 show a male screw rotor 105 used for the screw-type compressor. The male screw rotor 105 engages through the timing gear set 7 with the female screw rotor 37 without contacting therewith.

The screw rotor 105 consists of the rotor shaft 47 and a rotor body 107 fixed onto the outer periphery.

As shown in FIGS. 7 and 8, the rotor body 107 of the screw rotor 105 is provided with three screw-shaped tooth trace portions 109. The rotor body 107 is casted and machined, and formed in the tooth trace portion 109 is a hollow portion 111 communicating with the suction port 63, and provided at the end on the discharge port 65 side of the tooth trace portion 109 is a partition wall 113 for blocking the hollow portion 111. As with the above-mentioned screw rotors 35, 87, the partition wall 113 is provided with an opening 115 to facilitate the casting into a mold and the gas releasing at casting, and after casting, the opening 115 is blocked by being threadbare attached with the pin 79.

Provided at the end on the suction port 63 side on the inner periphery of the hollow portion 111 is a balancer 117 for keeping a rotational balance of the rotor body 107 against a mass of the partition wall 113.

Formed on the base portion 119 of the rotor body 107 are seven ribs 121 in the rotational direction.

This embodiment also has the same effect as the first embodiment.

Further, the reinforcing effect of the ribs 121 causes the rigidity of the tooth trace portion 109 to be improved, thus the screw rotor 105 to withstand a larger load, and a deformation of the tooth trace portion 109 to become less even at a rapid acceleration/deceleration, thereby preventing a contact between the screw rotors 105, 37. The ribs 121 serve as cooling fins to cause the cooling effect of the screw rotor 105 to be improved by a fresh air and thus a thermal expansion is relieved, whereby a variation in both a clearance between screw rotors 105, 37 and a clearance between the screw rotor 105 and the compressor casing 13 is reduced.

Although the above-mentioned embodiments have been explained in which the male screw rotor employs the hollow construction according to the composition of the present invention, in the present invention, the female screw rotor may employ the hollow construction, or both the male and female screw rotors may employ the hollow construction.

The screw rotor of the present invention may be manufactured by a method other than casting, for example, by pressing of a plate material.

Then, an example of a method of manufacturing the screw rotor of the present invention will be explained hereinafter.

Figure 9:
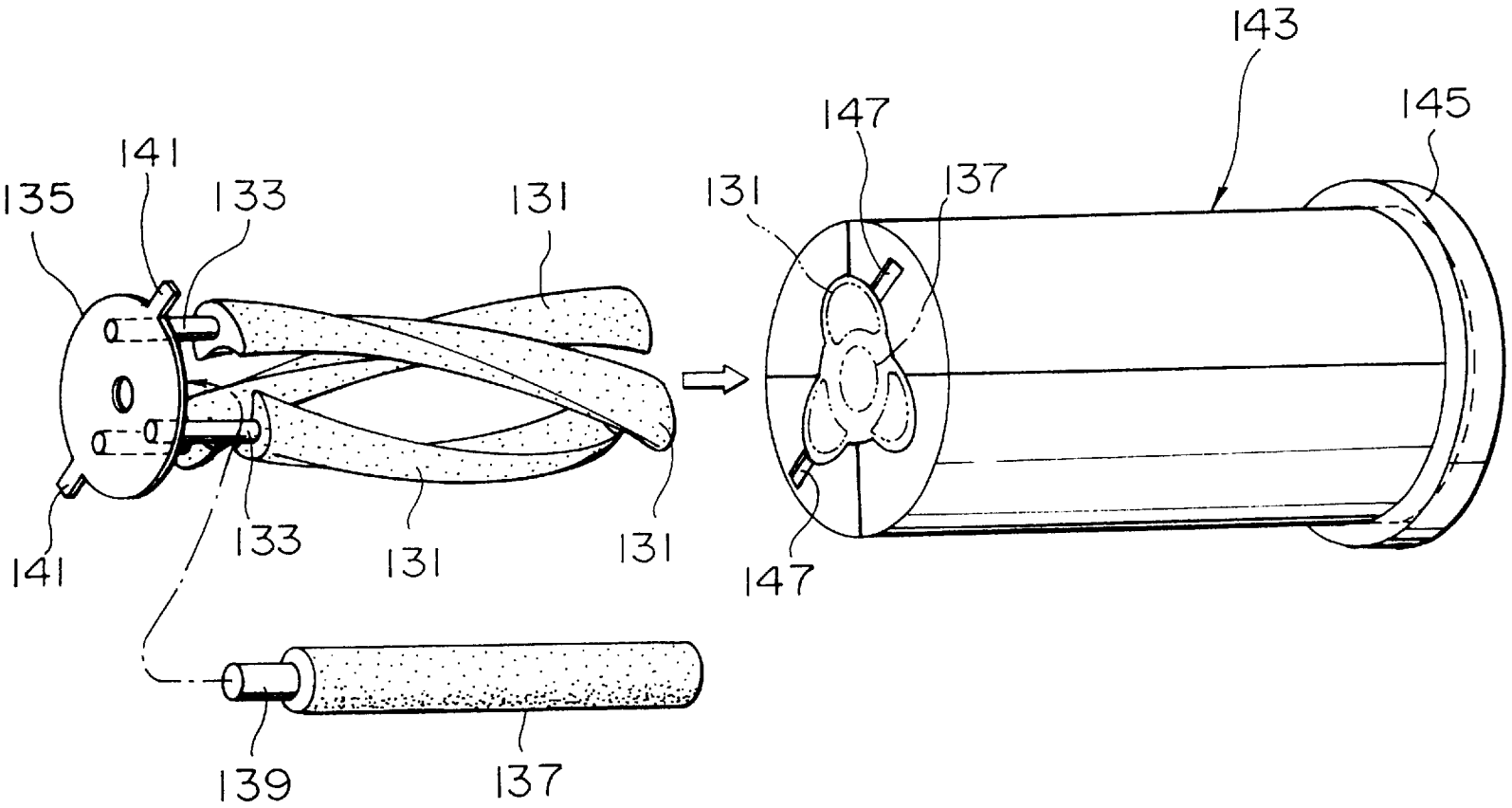
FIG. 9 shows a core supporting construction and an outer mold in a method of manufacturing a screw rotor of the present invention.

In this manufacturing method, the screw rotors 35, 37, 105 are manufactured by the following steps:

(1) A step of supporting an end of a disappearance-type core for forming hollow portions corresponding to the number of rotor tooth trace portions by a supporting member through a side bar penetrating a part of a portion becoming a partition wall after rotor forming and positioning the core (2) A step of setting the core in an outer mold for the rotor (3) A step of casting a molten metal into the mold and cooling the metal to solidify (4) A step of removing the outer mold and the core (5) A step of blocking a hole of the side bar penetrating a part of the partition wall with a blocking member FIG. 9 shows a core supporting construction and an outer mold in the above-mentioned manufacturing method. A plurality of (three in this embodiment) disappearance-type cores (usually sand mold) 131 formed into a spiral shape are supported through side bars 133 by a supporting member 135. Where a shaft hole is formed by a mold, a core 137 for the shaft hole is similarly supported through a side bar 139 by the supporting member 135. In the figure, the left side of the core 131 shows the rotor partition wall side, while the right side shows the rotor opening side. The bars 133 are arranged in a manner to penetrate a part of the partition wall after the rotor is formed. The supporting member 135 is provided with a pair of tabs 141 for positioning on the outer periphery. An outer mold 143 consists of a plurality of divided molds (in this embodiment, four divided ones) to facilitate the outer-shape accuracy matching and the core setting, and the right end is fittingly engaged with a ring-shaped base seat 145. The outer mold 143 has substantially the same inner shape as the outer diameter of the rotor tooth profile.

The outer mold 143 is provided with a pair of concave portions 147 for positioning the supporting member 141.

According to the manufacturing method, a hollow rotor having partition walls and openings can be easily manufactured at a high productivity and a reduced cost. Also the manufacturing method allows a rotor having a high spacing accuracy in the axial and rotational directions and thus a good rotational balance to be provided. For a rotor manufactured by this method, a contact between the rotors or between the rotor and the casing is prevented.

Then, a fourth embodiment of the present invention will be explained.

Figure 10:
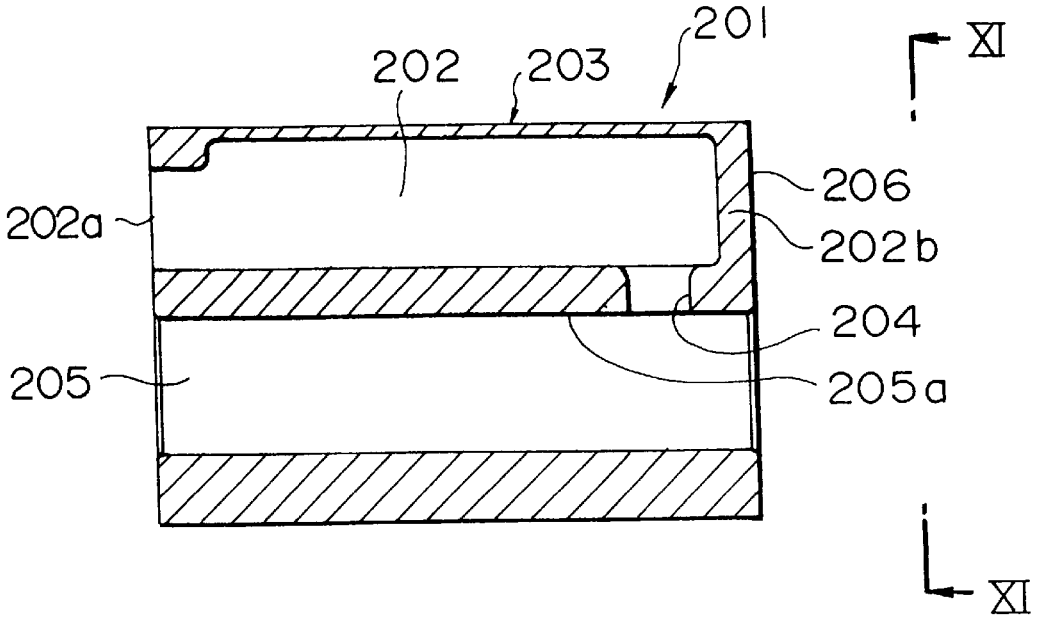
FIG. 10 is a sectional view along the tooth trace portion of a rotor of one embodiment of the present invention.
Figure 11:
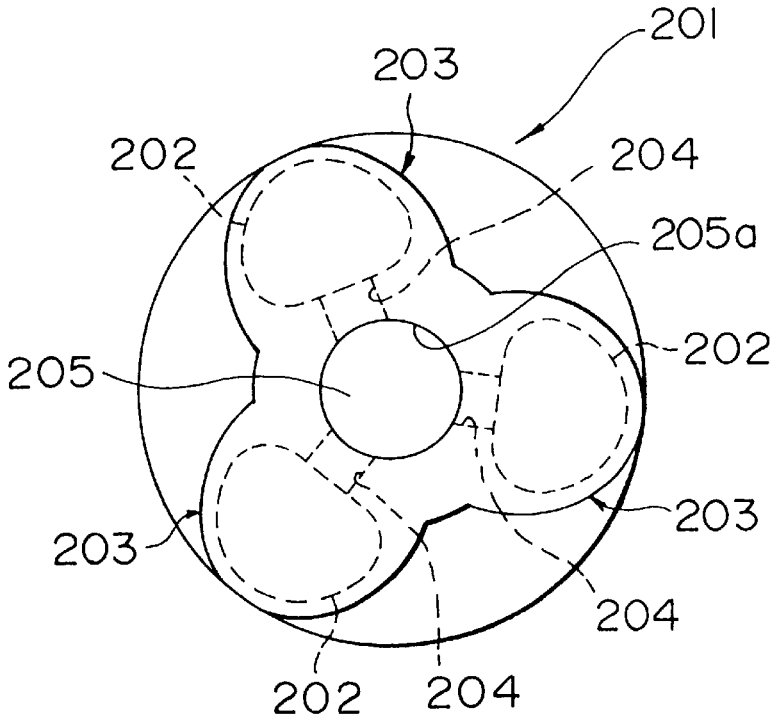
FIG. 11 is a view taken on line XI—XI in the arrow direction of FIG. 10.

FIG. 10 is a sectional view along a tooth trace portion 203 of a screw rotor 201 of this embodiment. Although actually the tooth trace portion 203 has been twisted into a screw shape, the tooth trace portion 203 is shown linearly for convenience and simplicity. FIG. 11 is an end view at the right side thereof.

The rotor 201 consists of a casted product made of a material such as aluminum, has screw-shaped tooth trace portions 203 on the outer periphery, and has a center hole 205 into which a rotor shaft (not shown) is fixedly pressure fitted. Hollow portions 202 for lightening weight are formed along the tooth trace portions 203. The hollow portion 202 is formed by a disappearance-type core 211 shown in FIG. 12 at casting.

The hollow portion 202 extending in the axial direction of the rotor 201 has an opening at one end face 202*a,* and is blocked by a wall 206 at the other end face 202*b*. Formed a portion near the wall 206 blocking the end face 202*b* is a side bar hole 204 of the disappearance-type core 211. The side bar hole 204 is formed by a side bar 214 for holding the disappearance-type core 211, has an opening on a plane 205*a* at which the inner periphery of the center hole 205 is fittingly engaged with a rotor shaft, and has no hole on the wall 206 of the above-mentioned end face 202*b*.

Figure 12:
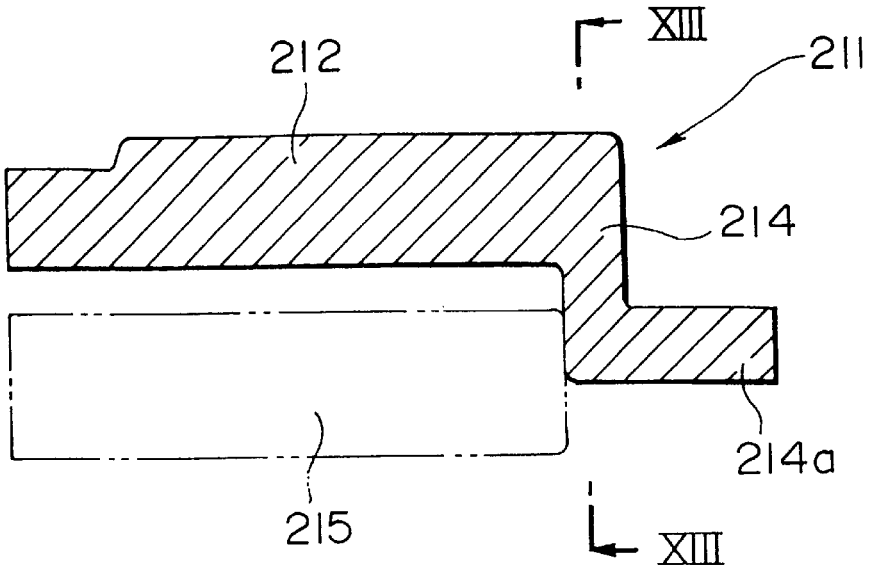
FIG. 12 is a sectional view of a casting core used to manufacture the rotor of FIG. 10.
Figure 13:
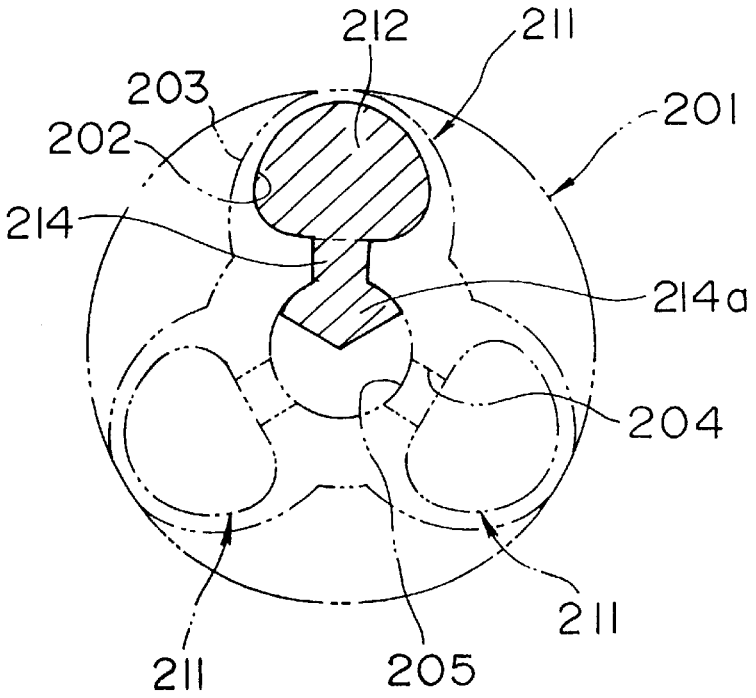
FIG. 13 is a sectional view taken on line XIII—XIII of FIG. 12.

With reference to FIGS. 12 and 13, the disappearance-type core 211 will be explained. FIG. 12 is a sectional view of the core 211; and FIG. 13 is a sectional view taken on line 13—13 in the arrow direction of FIG. 12.

The disappearance-type core 211 used to cast the rotor 201 is formed for each tooth trace portion 203 of the rotor 201. Each disappearance-type core 211 is formed of a material capable of being disappeared, for example, sand, and into a shape of the hollow portion 202 of the rotor 201 that a rotor body 212 can produce. The disappearance-type core 211 is also formed in a segment section of the central angle (in this example, the number of the tooth trace portions is three, so that the central angle is 120 degrees) corresponding to the number of the tooth trace portions 203 in such a manner that the central portion 214*a* in the diametrical direction at the point when the side bar 214 forming the side bar hole 204 is assembled exhibits a cylindrical shape, as shown in FIG. 13, when all cores 211 are assembled.

In this case, the number of the tooth trace portions 203 of the rotor 201 is three, and thus the three cores 211 are arranged in the circumferential direction, so that the cores 211 can be held stably by bundling of the central portions 214*a* of the segment sections of the side bars 214. FIG. 12 shows a relationship between one core 211 and a cylindrical core 215 for forming the center hole 205. Although the center hole 205 may be roughly worked by being casted, and then finished by a machine, the center hole 205 all may be wholly machined by a drill. Even for the whole machining by a drill, the side bar hole 204 at casting remains.

Where the rotor 201 is manufactured, three cores 211 are combined to bundle three central portions 214*a* of the side bar portions 214, and thus to form a core assembly having the bundled portion as a holding portion. Then, the core assembly is set in a mold to cast the rotor 201, and after casting, the core assembly is allowed to disappear, thereby obtaining a worked product as shown in FIG. 10.

According to this construction, the hollow portion 202 is provided in the tooth trace portions 203, so that the inertia efficiency of the rotor 201 can be made small. By pressure fitting of the rotor shaft into the center hole of the rotor 201, the side bar hole 204 can be securely blocked, so that no side bar hole is provided on the end face of the rotor 201, and thus an extra blocking of the hole, such as resin filling is not required, thereby preventing an increase in cost. There is no hole on the end face of the rotor, thereby eliminating such a problem that a compressed air leaks to cause the compression efficiency to be reduced.

Figure 15A:
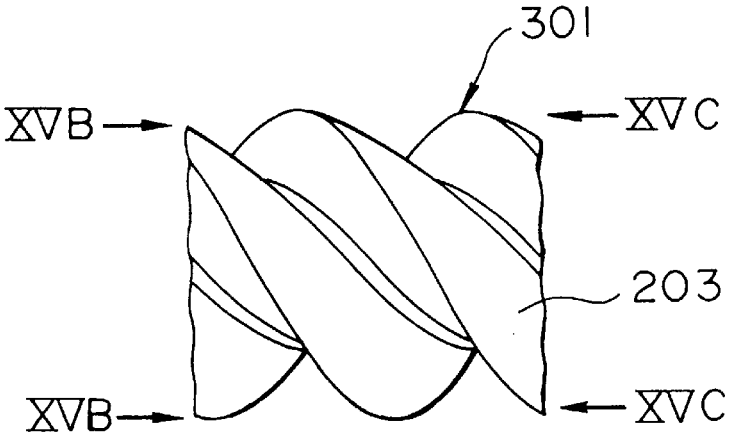
Figure 15B:
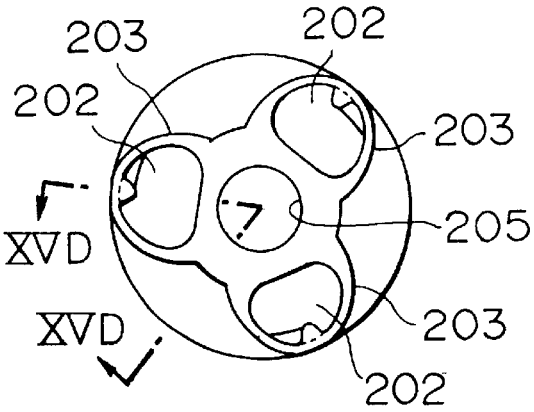
Figure 15C:
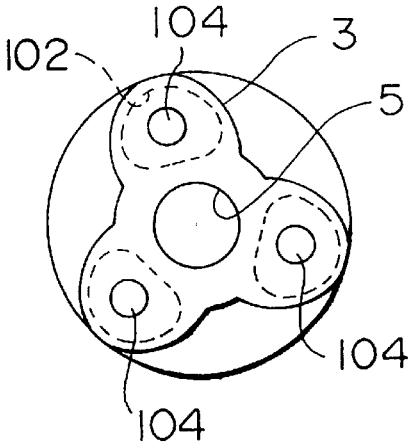
Figure 15D:
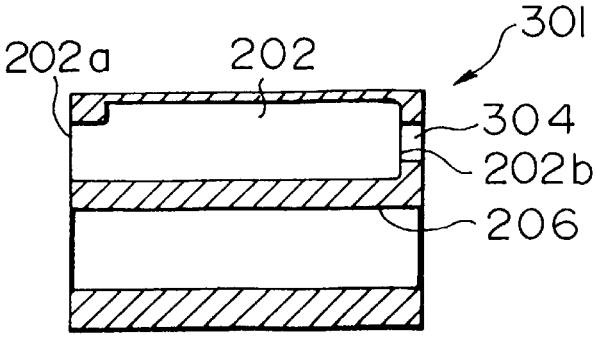
Figure 15E:
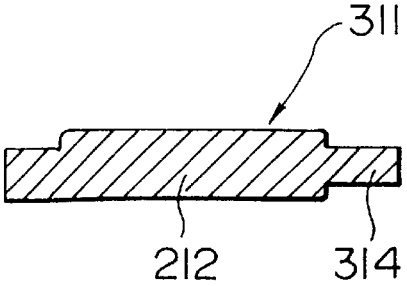

By the way, where a side bar hole 304 is provided on the wall 206 blocking the end face 202*b* of the hollow portion 202, like a rotor 301 shown in FIGS. 15A through 15D, the shape of a core 311, as shown in FIG. 15E, becomes a simple shape in which a side bar 314 extends straightly. However, in this case, the side bar hole 304 provided on the wall 206 of the end face 202*b* must be blocked later, thereby increasing a working cost.

Figure 14:
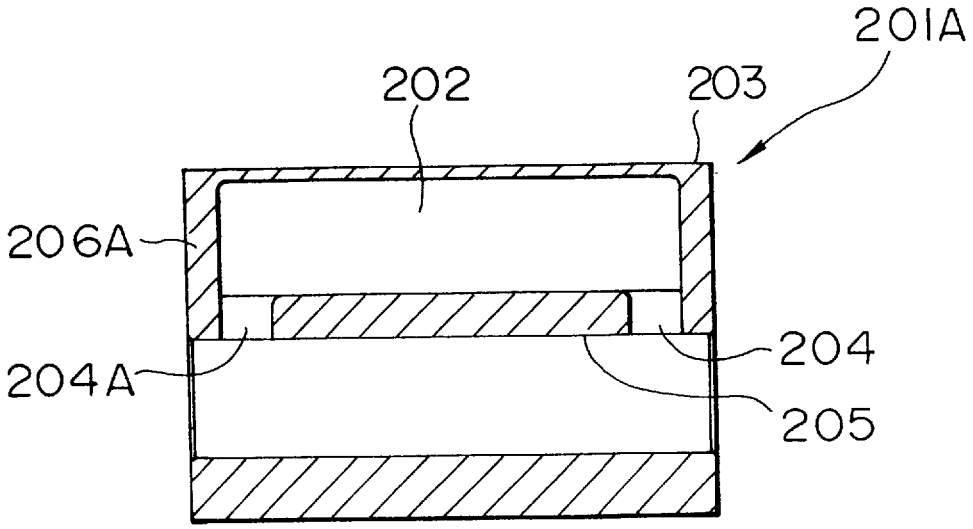
FIG. 14 is a sectional view along the tooth trace portion of a rotor of the other embodiment of the present invention.

Although in the above-mentioned embodiment, one end face 202*a* of the hollow portion 202 has been opened, if such opening does not interfere the disappearing of the disappearance-type core 211, the one end face 202*a* side may be blocked by a wall 206*a* as shown in FIG. 14. In this case, it is preferable that a side bar hole 204A similar to that on the opposite side is provided, and that a core is taken out of either or both of the side bar holes 204, 204A.

The side bar holes can be provided in a manner to be dislocated in the axial direction of the rotor shaft for each tooth trace portion.

The present invention can be applied to a female rotor as well as a male rotor.

What is claimed is:

1. A screw-type compressor comprising:

male and female rotors which engage with each other at screw-shaped tooth trace portions formed on the rotor bodies;

a compressor casing which houses these rotors and has a suction port on one side in the axial direction and a discharge port on the other side in the axial direction;

hollow portions which are provided in the tooth trace portions of either or both of the screw rotors and communicate with the suction port; and partition walls which are provided at the end on the discharge port side of the tooth trace portions and block the hollow portions.

2. A screw-type compressor as set forth in claim 1, wherein the rotor bodies are casted to provide the hollow portions and the partition walls in the tooth trace portions.

3. A screw-type compressor as set forth in claim 1 or 2, wherein ribs are provided on the inner periphery of the hollow portion.

4. A screw-type compressor as set forth in claim 1 or 2, wherein the inner periphery of the hollow portion is provided with a balancer for keeping a rotational balance with the partition wall.

5. A casted rotor for use in a screw-type compressor, comprising:

an elongated rotor body having a first end, a second end, and a center hole extending along the length of said rotor body into which a rotor shaft is adapted to be pressure fitted; and a plurality of screw-shaped tooth trace portions extending outwardly from said elongated rotor body, each of said screw-shaped tooth trace portions including a longitudinally extending hollow portion provided therein, each of said screw-shaped trace portions having an end wall formed at said first end of said elongated rotor body that encloses each longitudinally extending hollow portion, each of said screw-shaped trace portions further having an opening at said second end of said elongated rotor body;

wherein fluid can flow into said longitudinally extending hollow portions through said openings but is prevented from flowing completely through said elongated rotor body by said end walls such that pressure leakage through said rotor will not occur when said rotor is used in the screw type compressor.

6. The casted rotor of claim 5, wherein each of said screw-shaped tooth trace portions includes a side bar hole that extends between each of said longitudinally extending hollow portions and said center hole such that each of said longitudinally extending hollow portions are in fluid communication with said center hole.

7. The casted rotor of claim 5, wherein each of said end walls includes an opening formed therein that is plugged with a pin fixedly positioned therein.

* * * * *